US009074820B2

(12) United States Patent
Hayasaka et al.

(10) Patent No.: US 9,074,820 B2
(45) Date of Patent: Jul. 7, 2015

(54) HEAT EXCHANGER

(75) Inventors: Atsushi Hayasaka, Anjo (JP); Masahiro Shimoya, Kariya (JP); Mitsugu Nakamura, Anjo (JP); Takashi Taki, Okazaki (JP); Masahiro Omae, Kariya (JP); Aun Ota, Okazaki (JP)

(73) Assignee: DENSO CORPORATION, Kariya (JP)

( * ) Notice: Subject to any disclaimer, the term of this patent is extended or adjusted under 35 U.S.C. 154(b) by 849 days.

(21) Appl. No.: 12/842,059

(22) Filed: Jul. 23, 2010

(65) Prior Publication Data

US 2011/0017440 A1 Jan. 27, 2011

(30) Foreign Application Priority Data

Jul. 24, 2009 (JP) ..... 2009-173055
Jul. 2, 2010 (JP) ..... 2010-151905

(51) Int. Cl.

| | |
|---|---|
| ***F28D 1/02*** | (2006.01) |
| ***F28F 1/42*** | (2006.01) |
| ***F28F 1/20*** | (2006.01) |
| ***F28F 1/30*** | (2006.01) |
| ***F28D 1/053*** | (2006.01) |
| ***F28F 1/12*** | (2006.01) |
| *F28F 1/32* | (2006.01) |

(52) U.S. Cl.

CPC ..... *F28D 1/05366* (2013.01); *F28F 1/32* (2013.01); *F28F 1/42* (2013.01); *F28F 1/128* (2013.01)

(58) Field of Classification Search

CPC ..... F28F 1/128; F28F 1/42; F28F 1/32
USPC ..... 165/152, 179, 181, 182, 153
See application file for complete search history.

(56) References Cited

U.S. PATENT DOCUMENTS

| | | | | |
|---|---|---|---|---|
| 1,993,872 A | | 3/1935 | Chase | |
| 2,011,854 A | * | 8/1935 | Emmons et al. | 72/379.6 |
| 2,651,505 A | * | 9/1953 | Freer | 165/158 |
| 3,757,856 A | * | 9/1973 | Kun | 165/166 |

(Continued)

FOREIGN PATENT DOCUMENTS

| | | | | |
|---|---|---|---|---|
| JP | U-62-131279 | | 8/1987 | |
| JP | 05-340686 | * | 12/1993 | F28F 1/42 |

(Continued)

OTHER PUBLICATIONS

Office action dated Jan. 29, 2012 in corresponding Chinese Application No. 2010 10234100.2.

(Continued)

*Primary Examiner* — M. Alexandra Elve
*Assistant Examiner* — Joel Attey
(74) *Attorney, Agent, or Firm* — Harness, Dickey & Pierce, PLC

(57) ABSTRACT

A heat exchanger includes a plurality of flat tubes in which a fluid flows, and a plurality of fins each of which is connected to flat surfaces of adjacent tubes to increase a heat exchange area on a side of air flowing outside of the tube. The fin includes a plate portion having a plate surface, and fin protrusions protruding from the plate surface of the plate portion. The fin protrusions are provided to be spaced from the flat surface of the tube by a predetermined distance. A flow resistance portion is provided to protrude from the flat surface of the tube toward outside by a protrusion dimension that is equal to or larger than the predetermined distance.

19 Claims, 12 Drawing Sheets

(56) References Cited

U.S. PATENT DOCUMENTS

| | | | | |
|---|---|---|---|---|
| 4,488,593 | A * | 12/1984 | Mulock-Bentley | 165/151 |
| 5,487,424 | A * | 1/1996 | Davison | 165/166 |
| 2004/0069472 | A1* | 4/2004 | Shimoya | 165/165 |
| 2007/0012430 | A1 | 1/2007 | Duke et al. | |
| 2007/0029074 | A1* | 2/2007 | Helms et al. | 165/152 |
| 2007/0199686 | A1* | 8/2007 | Okinotani et al. | 165/152 |
| 2007/0209786 | A1* | 9/2007 | Shimoya et al. | 165/152 |
| 2008/0179048 | A1* | 7/2008 | Yaezawa et al. | 165/152 |
| 2008/0190589 | A1* | 8/2008 | Kramer | 165/152 |
| 2009/0173479 | A1* | 7/2009 | Huang | 165/152 |
| 2009/0173480 | A1* | 7/2009 | Huang et al. | 165/152 |
| 2009/0250199 | A1* | 10/2009 | Zhang et al. | 165/152 |

FOREIGN PATENT DOCUMENTS

| | | |
|---|---|---|
| JP | H05-340686 | 12/1993 |
| JP | 2009-162433 | 7/2009 |

OTHER PUBLICATIONS

Journal of Nippondenso Technical Disclosure (No. 70-139, Published on Feb. 15, 1990).

Ralph L. Webb, et al. "Principles of Enhanced Heat Transfer", Second Edition, pp. 58-59. (corresponds to JP U-62-131279 above).

Office Action issued Oct. 10, 2012 in corresponding Chinese Application No. 2010 10234100.2 with English translation.

Office Action issued Jul. 30, 2013 in corresponding Japanese Application No. 2010-151905 (with English translation).

Office Action dated Apr. 23, 2013 in corresponding Chinese Application No. 2010 10234100.2 with English translation.

Notification of Reexamination mailed Jul. 16, 2014 in the corresponding CN Application No. 2010 1023 4100.2 with English translation.

* cited by examiner

HEAT EXCHANGER

CROSS REFERENCE TO RELATED APPLICATION

This application is based on Japanese Patent Applications No. 2009-173055 filed on Jul. 24, 2009, and No. 2010-151905 filed on Jul. 2, 2010, the contents of which are incorporated herein by reference in its entirety.

FIELD OF THE INVENTION

The present invention relates to a heat exchanger including a plurality of tubes and a plurality of fins. For example, the heat exchanger may be suitably used as a heat exchanger for a vehicle air conditioning, such as a refrigerant radiator, a refrigerant evaporator, a heater core or the like.

BACKGROUND OF THE INVENTION

A conventional heat exchanger includes a heat exchange core portion for performing heat exchange between a fluid and air. The heat exchange core portion is configured by a plurality of flat tubes in which the fluid such as water or refrigerant flows, and fins bonded to flat surfaces of the flat tubes. The fins of the heat exchange core portion are provided with louvers formed by cutting and standing the fin surfaces. Because the louvers are formed in the fins, it can prevent a temperature boundary layer from being continuously developed, thereby improving heat exchanging performance.

If the louvers are formed in a contact portion of the fin contacting the flat surface of the flat tube, a contact error may be easily caused at the contact portion between the flat tube and the fin. Thus, the louvers are generally formed in the fin at positions separated from the contact portion contacting the flat tube by a predetermined distance. Accordingly, when air passes the fins at the positions without having the louvers, heat exchanging performance on the air side of the heat exchanger may be not sufficiently improved.

Non-Patent Document 1 proposes a heat exchanger, in which circular-arc protrusion portions are provided at two end portions of the respective flat tubes thereby reducing an air amount flowing to the side of the fins without having the louvers (Non-Patent Document 1: JOURNAL OF NIPPON-DENSO TECHNICAL DISCLOSURE, No. 70-139, Published on Feb. 15, 1990).

However, in the Non-Patent Document 1, the protrusion portions are only provided at the two end portions of the respective flat tubes in an air flow direction. Therefore, air can flow to the flat surfaces of the flat tubes between the tube end protrusion portions. Thus, air flows to the fins at positions adjacent to the contact portion without having the louvers, and heat exchanging performance on the air side of the heat exchange cannot be effectively improved.

SUMMARY OF THE INVENTION

The present invention is made in view of the above matters, and it is an object of the present invention to provide a heat exchanger which can effectively improve heat exchanging performance.

According to an aspect of the present invention, a heat exchanger includes a plurality of flat tubes in which a fluid flows, a plurality of fins each of which is connected to flat surfaces of adjacent tubes to increase a heat exchange area on a side of air flowing outside of the tubes, and a flow resistance portion protruding from the flat surface of the tube to outside by a protrusion dimension. The fin includes a plate portion having a plate surface, and fin protrusions protruding from the plate surface of the plate portion. Furthermore, the fin protrusions are provided to be spaced from the flat surface of the tube by a predetermined distance, and the protrusion dimension of the flow resistance portion protruding from the flat surface of the tube is equal to or larger than the predetermined distance.

Because the protrusion dimension of the flow resistance portion protruding from the flat surface of the tube is equal to or larger than the predetermined dimension, a flow resistance of air flowing to a portion of the fin surface without the fin protrusions can be increased. Therefore, the flow speed or/and the flow amount of air flowing to the portion of the fin surface without the fin protrusions can be reduced, and thereby the flow speed or/and the flow amount of air flowing to the portion of the fin surface having the fin protrusions can be relatively increased. Accordingly, the heat exchange performance can be effectively increased in the heat exchanger.

For example, a ratio of the protrusion dimension of the flow resistance portion to the predetermined distance may be in a range of from 1 to 3.5. In this case, the heat exchange performance can be further effectively improved.

Furthermore, a part of the flat surface of the tube may protrude from an inside of the tube to an outside of the tube, to form the flow resistance portion and a recess portion that is provided on an inner wall surface of the tube at a position where the flow resistance portion is provided. Alternatively, the flow resistance portion may be a member different from the tube, and may be bonded to the flat surface of the tube.

The flow resistance portion may be provided respectively on the opposite flat surfaces of the tube, or may be provided on the flat surface of the tube at least at an upstream portion in an air flow direction.

In the heat exchanger, the flow resistance portion may be configured by a plurality of protrusion portions that are arranged at an interval of a pitch dimension of the fin in a flow direction of the fluid flowing in the tube.

Alternatively, the plurality of tubes may include first tubes each of which is provided with the flow resistance portion, and second tubes without the flow resistance portion. In this case, the first tubes and the second tubes may be alternately arranged in a tube stacking direction.

The flow resistance portion may be configured by a plurality of protrusion portions. In this case, each of the protrusion portions protruding from the flat surface of the tube to the outside may have approximately a semispheric shape or a half-ellipsoid shape or the like.

Furthermore, the fin protrusions may be slit-window shaped louvers that are provided by cutting and standing a part of the plate portion of the fin. In addition, the fin may have a louver forming portion in which the louvers are provided, and a non-cut portion at two sides of the louver forming portion in a tube stacking direction. In this case, the non-cut portion of the fin may be connected to the flat surface of the tube, and the protrusion dimension of the flow resistance portion may be equal to larger than a dimension of the non-cut portion in the tube stacking direction.

The flat surface of the tube may be provided with a plurality of inner protrusion portions protruding from an inner face of the flat surface of the tube to inside of the tube.

In addition, the flow resistance portion may be configured by a plurality of outer protrusion portions protruding from an outer face of the flat surface of the tube to outside of the tube. In this case, the outer protrusion portions and the inner protrusion portions may be alternatively arranged in one flat surface of the tube. Alternatively, the outer protrusion portions may be provided in one flat surface of the tube, and the inner protrusion portions may be provided in the other flat surface of the tube, opposite to the one flat surface.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
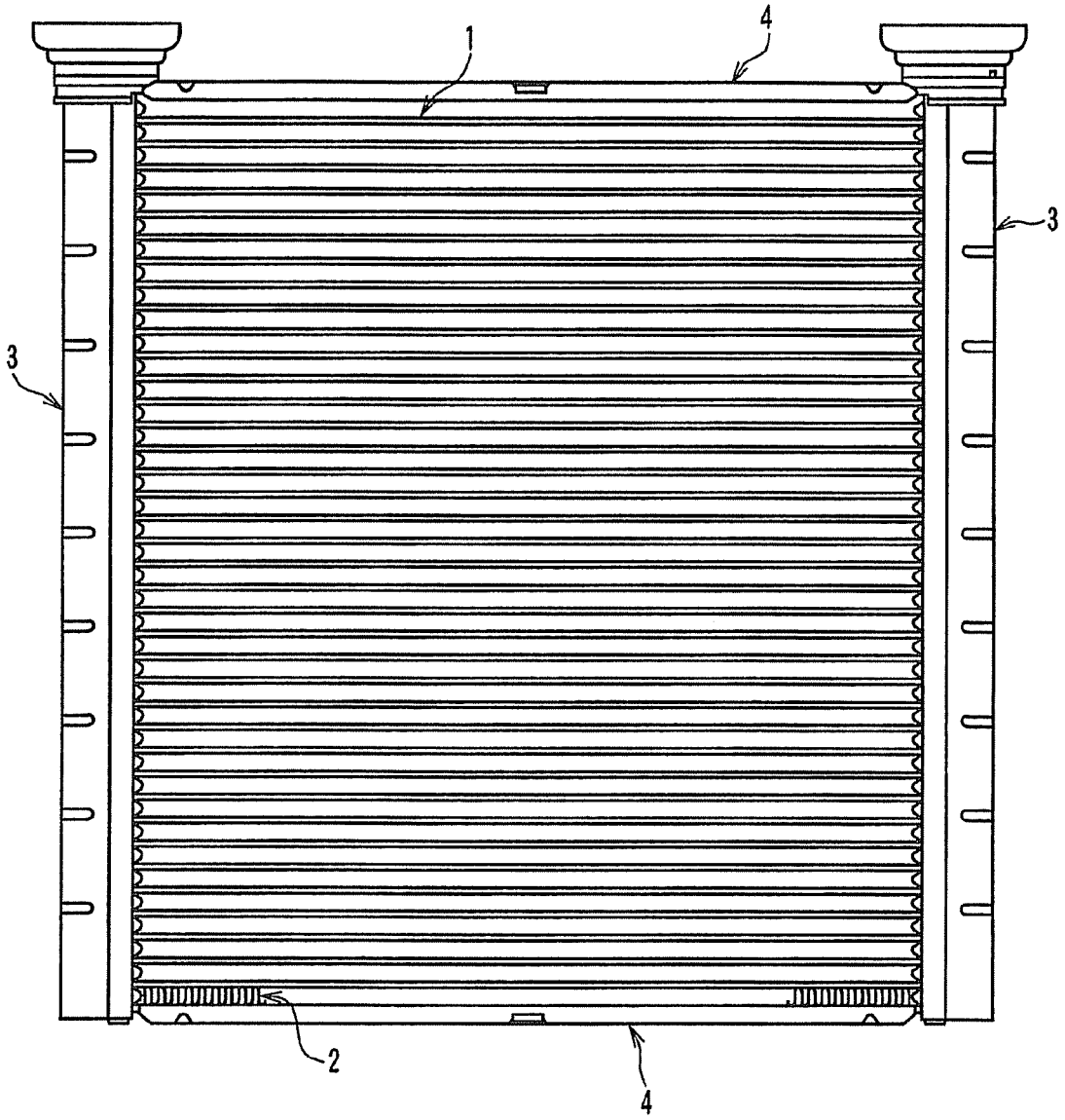
FIG. 1 is a front view showing a heat exchanger according to an embodiment of the invention.
Figure 2:
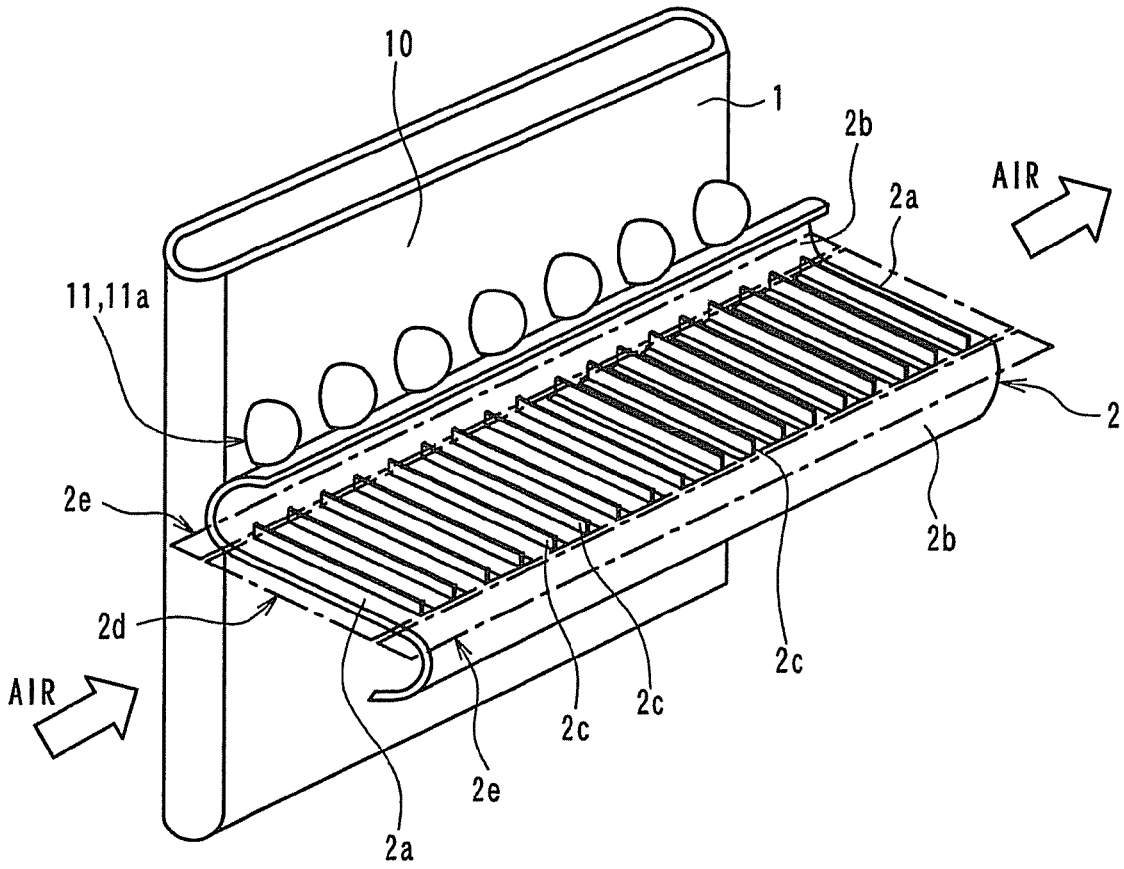
FIG. 2 is a perspective view showing a part of a core portion of the heat exchanger according to the embodiment of the invention.
Figure 3A:
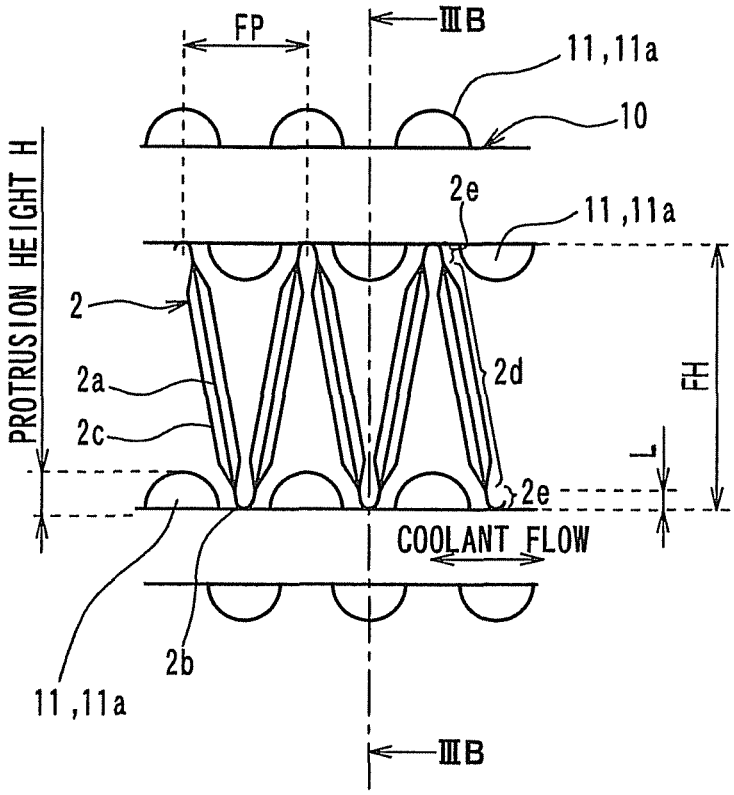
FIG. 3A is a schematic diagram showing flow resistance portions formed on flat surfaces of flat tubes and non-cut portions of the fins according to the embodiment.
Figure 3B:
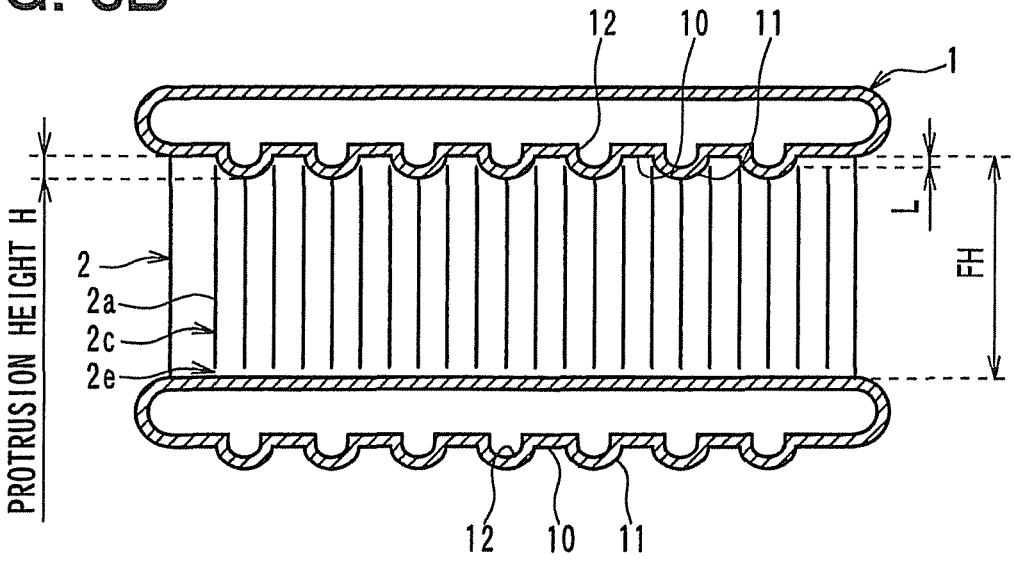
FIG. 3B is a cross-sectional view taken along the line IIIB-IIIB in FIG. 3A.

An embodiment of the present invention will be described hereafter with reference to FIGS. 1 to 6. In the present embodiment, a heat exchanger of the invention is typically used as a heater core for a heating in a vehicle air conditioner. FIG. 1 is a front view showing a heat exchanger of the present embodiment, which is used as the heater core for heating a vehicle compartment. FIG. 2 is a schematic perspective view showing a part of a core portion of the heater core shown in FIG. 1. FIG. 3A is a schematic diagram showing flow resistance portions formed on flat surfaces of flat tubes and non-cut portions of the fins according to the embodiment, and FIG. 3B is a cross-sectional view taken along the line IIIB-IIIB in FIG. 3A.

The heat exchanger as the heater core is configured to perform heat exchange between engine coolant (hot water) heated by exhaust heat of a vehicle engine and air to be blown into the vehicle compartment. Thus, the heater core is a heating heat exchanger for heating air to be blown into the vehicle compartment. The engine coolant is supplied to the heater core by a water pump (not shown) provided in an engine coolant circuit, and air is supplied to the heater core by a blower fan (not shown) located at a vehicle rear side of the heater core.

The heat exchanger as the heater core is provided with a heat exchange core portion for performing heat exchange between the engine coolant and air. As shown in FIG. 1, the heat exchange core portion includes a plurality of flat tubes 1 in which engine coolant flows, and a plurality of fins 2. The tubes 1 are stacked in a tube stacking direction, and the fins 2 are located between adjacent the tubes 1 to be bonded to the outer flat surfaces 10 of the tubes 1. Thus, the fins 2 increase a heat exchange area on the air side, and can facilitate the heat exchange between the engine coolant and air.

A pair of head tanks 3 are located at two longitudinal end sides of the tubes 1, to extend in a direction perpendicular to the longitudinal direction of the tubes 1 and to communicate with the respective tubes 1. Furthermore, two side plates 4 are located at two sides of the core portion in the tube stacking direction, so as to reinforce the core portion.

For example, the tubes 1, the fins 2, the header tanks 3 and the side plates 4 are made of metal (e.g., aluminum alloy), and are bonded integrally by brazing.

As shown in FIG. 2, each tube 1 is a flat tube in cross section, and defines a fluid passage (e.g., coolant passage in the present embodiment) therein. Each of the tubes 1 is bonded to the header tank 3 such that a major direction in cross section of the tube 1 corresponds to the air flow direction, as shown in FIGS. 1 and 2. Thus, the air flow direction is perpendicular to the longitudinal direction and the tube stacking direction.

The fins 2 are bonded to the outer flat surfaces 10 of the tubes 1 by brazing. The fins 2 are corrugated fins each of which is formed into a wave shape. Each of the fins 2 is bent to have adjacent two plate portions 2*a*, and a bending portion 2*b* that is bent to continuously connect the adjacent two plate portions 2*a*. The bending portions 2*b* of the corrugated fin 2 are brazed to the outer flat, surface 10 of the tube 1. In the example of FIG. 2, the bending portions 2*b* of the corrugated fin 2 are provided to be connected to the outer flat surfaces 10 of the adjacent tubes 1.

A plurality of strip-window shaped louvers 2*c* as fin protrusions are formed in each plate portion 2*a* to protrude from a plate surface of the plate portion 2*a* in a direction crossing with an air flow direction. The plurality of louvers 2*c* are formed by cutting and standing a part of the plate portion 2*a*. Thus, air passing on the plate surface of the plate portion 2*a* of the fin 2 collides with the fin plate surface thereby disturbing the air flow, so that heat transmission efficiency on the air side can be increased.

Two ends of the respective louvers 2*c* in the direction perpendicular to the air flow direction are provided at positions separated from the bending portion 2*b*, so as to be separated by a predetermined distance L from the contact portion between the flat surface 10 of the tube 1 and the bending portion 2*b*. Thus, the fin 2 has a louver forming portion 2*d* in which the louvers 2*c* are formed by cutting and standing a part of the fin 2, and a non-cut portion 2*e* in which the louver 2*c* is not formed. The non-cut portion 2*e* is provided between the louver end of the fin 2 and the flat surface 10 of the tube 1, in the direction perpendicular to the air flow direction, as shown in FIG. 2.

As shown in FIGS. 3A and 3B, when a distance of the non-cut portion 2*e* between each end of the louvers 2*c* and the adjacent flat surface 10 of the tube 1 in the tube stacking direction perpendicular to the air flow direction is L, the distance L of the non-cut portion 2*e* is approximately in a range of 5% to 8% of the fin height FH of the fin 2. Here, the fin height FH is a fin dimension between the adjacent tubes 1 in the tube stacking direction. For example, when the fin height FH is 4 mm, the distance L of the non-cut portion 2*e* is about 0.2 mm.

Because the louver 2*c* is not formed in the non-cut portion 2*e*, the heat transmission efficiency on the air side may be lowered as compared with a case where the louvers 2*c* are formed even in the area of the non-cut portion 2*e*. Thus, in order to improve the heat transmission performance of the fins 2 on the air side, it is necessary to reduce the flow amount of air passing through the non-cut portion 2*e* and to increase the flow amount of air passing through the louver forming portion 2*d*.

In the present embodiment, a flow resistance portion 11 is provided on the flat surface 10 between adjacent bending portions 2*b*, so that the flow of air passing through the non-cut portion 2*e* is interrupted. In the present embodiment, the flow resistance portion 11 is provided respectively in the plural tubes 1.

As shown in FIGS. 2 and 3A, a plurality of semisphere protrusion portions 11*a* are provided as the flow resistance portion 11 to protrude to outside (air side) from each flat surface 10 of the tube 1. Thus, a plurality of recess portions 12 are formed in the inner wall surface on each flat surface 10 of the tube 1, at positions where the protrusion portions 11*a* are formed. A plurality of the protrusion portions 11*a* (e.g., seven) are arranged on the outer flat surface 10 of the tube 1 in a line at an equal interval in the air flow direction, as shown in FIG. 3B.

Furthermore, as shown in FIG. 3A, the protrusion portions 11*a* as the flow resistance portion 11 are arranged in a direction parallel to the flow direction of the engine coolant flowing in the tubes 1, to be spaced from each other by a distance equal to a fin pitch FP of the corrugated fin 2 in the flow direction of the engine coolant. Here, the flow direction of the engine coolant in the tubes 1 corresponds to the tube longitudinal direction, and is perpendicular to the air flow direction. As shown in FIG. 3A, the fin pitch FP of the corrugated fin 2 is the distance between adjacent bending portions 2*b* in the tube longitudinal direction (i.e., coolant flow direction in the tube 1).

The protrusion portions 11*a* are formed integrally with the tube 1, by protruding a part of the flat surface 10 from the inside of the tube 1 where the engine coolant flows, to the outside of the tube 1 where air flows. Thus, the recess portions 12 are formed in the inner wall surface of the tube 1, at positions where the protrusion portions 11*a* are formed.

In the present embodiment, the protrusion portions 11*a* as the flow resistance portions 11 of the air flow are formed, such that the protrusion height H of the protrusion portion 11*a* becomes larger than the length L of the non-cut portion 2*e* in a direction perpendicular to the flat surface 10. Here, the protrusion height H is the protrusion dimension of the protrusion portion 11*a* in the direction perpendicular to the flat surface 10, and the direction perpendicular to the flat surface 10 corresponds to the tube stacking direction. For example, when the length L of the non-cut portion 2*e* is 0.2 mm, the protrusion height H of the protrusion portion 11*a* can be set at 0.4 mm. By suitably setting the protrusion height H of the protrusion portion 11*a*, the heat exchanging performance on the air side can be suitably improved.

Generally, the heat exchanging performance of the fin 2 is increased in accordance with an increase in a flow speed or/and a flow amount of air passing through the louver forming portion 2*d*. The inventors studied about the heat transmission performance of the fins 2 in accordance with the variations in the flow speed, the flow amount or the like of air flowing on the fin plate surface, in a case where the protrusion portions 11*a* are provided on one side of the fin 2 and in a case where the provision portions 11*a* are not provided.

Figure 4A:
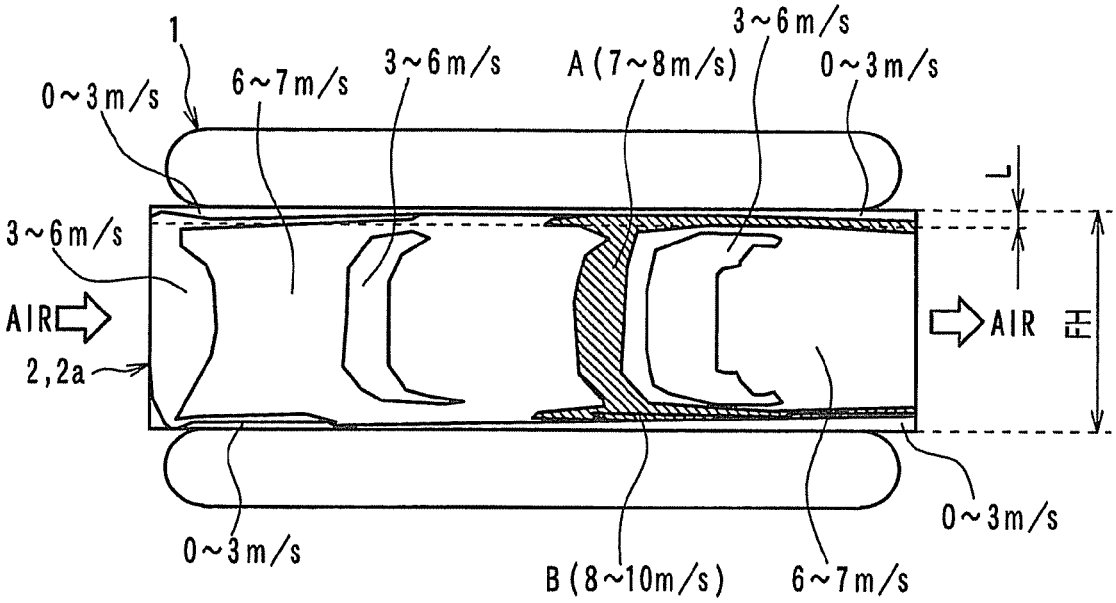
FIG. 4A is a schematic diagram showing a variation of the air flow on a fin between adjacent tubes in a comparative example in which protrusion portions as a flow resistance portion are not provided on the adjacent tubes.
Figure 4B:
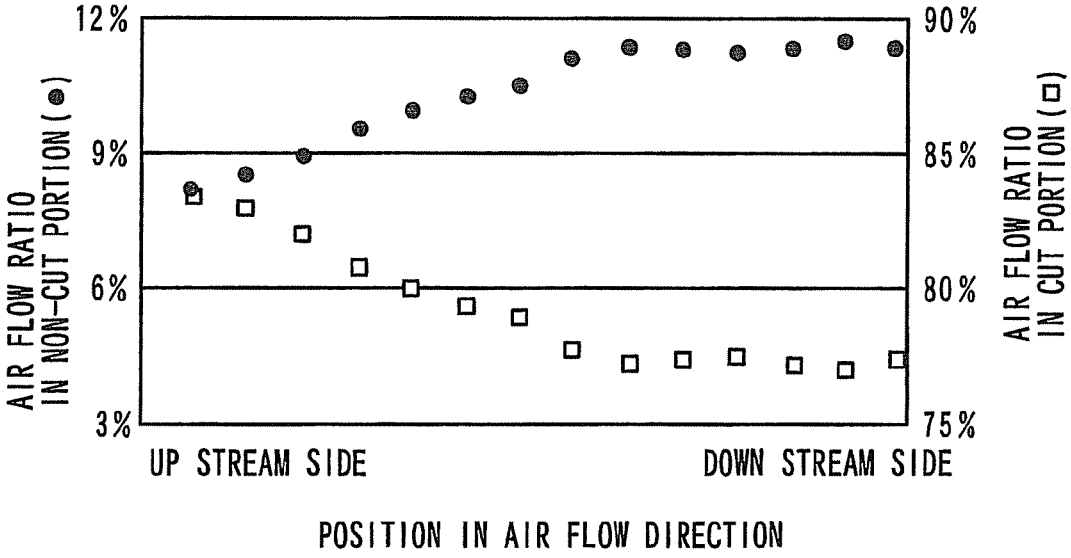
FIG. 4B is a graph showing the relationship between a position in an air flow direction, a flow ratio of air flowing on one-side non-cut portion of the fin, and a flow ratio of air flowing on a cut portion of the fin in the comparative example of FIG. 4A.
Figure 5A:
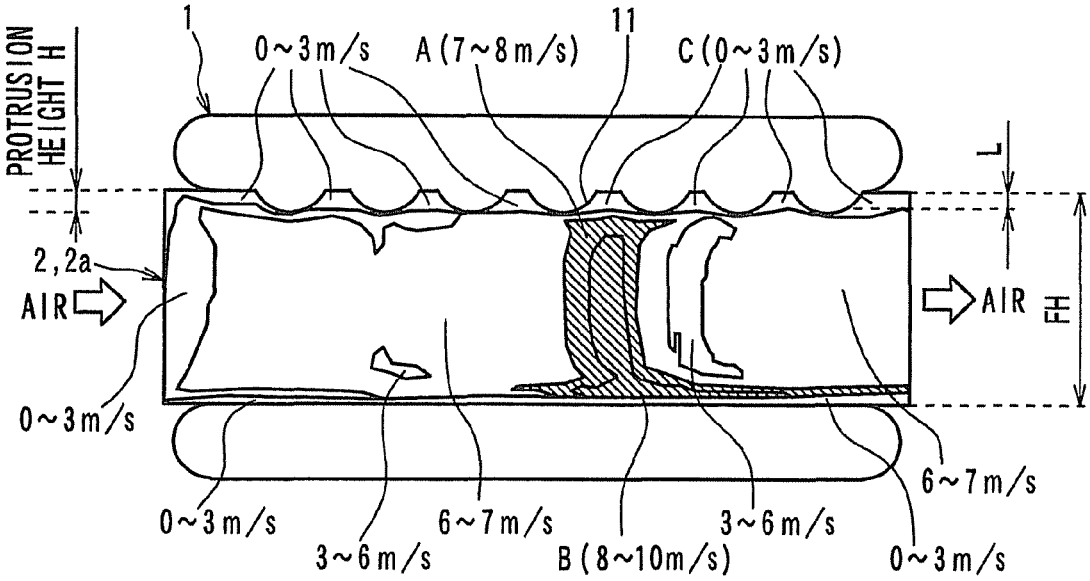
FIG. 5A is a schematic diagram showing a variation of the air flow on a fin between adjacent tubes in an example of the embodiment in which protrusion portions as a flow resistance portion are provided on the tubes at one side of the fin.
Figure 5B:
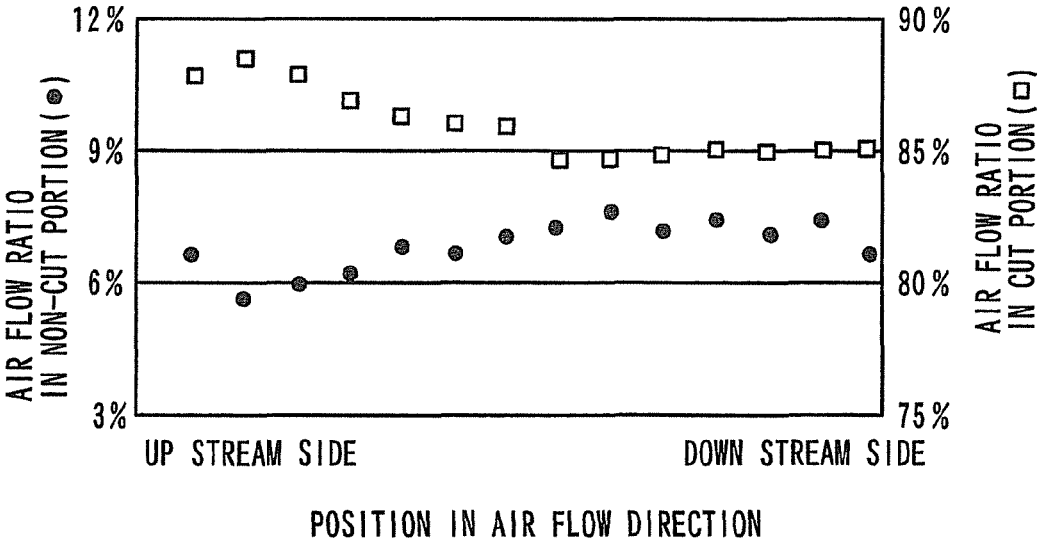
FIG. 5B is a graph showing the relationship between a position in an air flow direction, a flow ratio of air flowing on one-side non-cut portion of the fin, and a flow ratio of air flowing on a cut portion of the fin in the example of FIG. 5A.

Next, the inventor's experiments and the results thereof will be described based on FIGS. 4A to 5B. FIGS. 4A and 4B are diagrams showing variations in the air flow passing the fin plate surface in a case where the protrusion portions 11*a* are not provided, and FIGS. 5A and 5B are diagrams showing variations in the air flow passing the fin plate surface in a case where the protrusion portions 11*a* are provided at one side. FIGS. 4A and 5A show distributions of the air flow on the fin plate surface when viewing the flat portion 2*a* of the fin 2 from the longitudinal direction of the tube 1. In FIGS. 4B and 5B, the horizontal axis shows the position of the fin surface in the air flow direction, from the upstream side to the downstream side. Furthermore, in FIGS. 4B and 5B, the left-side vertical axis shows an air flow ratio (%) in the one side (upper side in FIGS. 4A and 5A) of the non-cut portion 2*e* indicated by "•", and the right-side vertical axis shows an air flow ratio (%) in the louver forming portion 2*d* indicated by "□". In the experiments, a total air flow ratio on both the upper and lower non-cut portions 2*e* is set as a total air amount (100%).

In FIG. 4A, the areas indicated by A and B are the areas where the flow speed becomes equal to or larger than 7 m/s. As shown by the areas A and B in FIG. 4A, in the heat exchanger without having the protrusion portions 11*a* on the flat surface 10 of the tube 1, the flow speed of air on the downstream side in the non-cut portion 2*e* of the fin plate surface becomes maximum in the area B, and the flow speed of air in the louver forming portion 2*d* becomes smaller than the flow speed of air in the non-cut portion 2*e* of the area B. Furthermore, as shown in FIG. 4B, the air flow ratio in the non-cut portion 2*e* on the downstream side is about 11%, while the air flow ratio in the louver forming portion 2*d* (cut portion) is about 77%.

As shown by the areas A, B and C in FIG. 4A, in the heat exchanger provided with the protrusion portions 11*a* on the flat surface 10 of the tube 1 at the upper side, the flow speed of air on the downstream side in the non-cut portion 2*e* of the fin plate surface becomes minimum as in the area C, and the flow speed of air in the louver forming portion 2*d* becomes larger than the flow speed of air in the non-cut portion 2*e* in the area C. In FIG. 5A, because the protrusion portions 11*a* are not provided on the lower side, the flow speed becomes equal to or larger than 7 m/s in the area B. Furthermore, as shown in FIG. 5B, the air flow ratio at the upper side non-cut portion 2*e* on the downstream side is about 7%, while the air flow ratio at the louver forming portion 2*d* (cut portion) is about 85%.

Thus, in the heat exchanger provided with the protrusion portions 11*a* on the flat surface 10 of the tube 1, the flow speed and the flow amount of air passing through the louver forming portion 2*d* provided with the louvers 2*c* can be effectively increased as compared with a heat exchanger without having the protrusion portions 11*a*. Accordingly, by providing the protrusion portions 11*a* on the flat surface 10 of the tube 1, the heat transmission performance of the fins 2 on the air side can be effectively improved.

As the protrusion height H of the protrusion portion 11*a* becomes larger with respect to the length L of the non-cut portion 2*e*, the flow resistance of air flowing in the core portion becomes larger, thereby increasing the power consumed in the blower fan and reducing the heat transmission efficiency.

Thus, in the present embodiment, the protrusion height H of the protrusion portion 11*a* is suitably set with respect to the dimension L of the non-cut portion 2*e*. For example, a ratio (H/L) of the protrusion height H of the protrusion portion 11*a* to the length L of the non-cut portion 2*e* is set in a range of 1.0 to 3.5. In this case, the heat transmission performance is evaluated while the pump power of the blower fan is set in constant.

Figure 6:
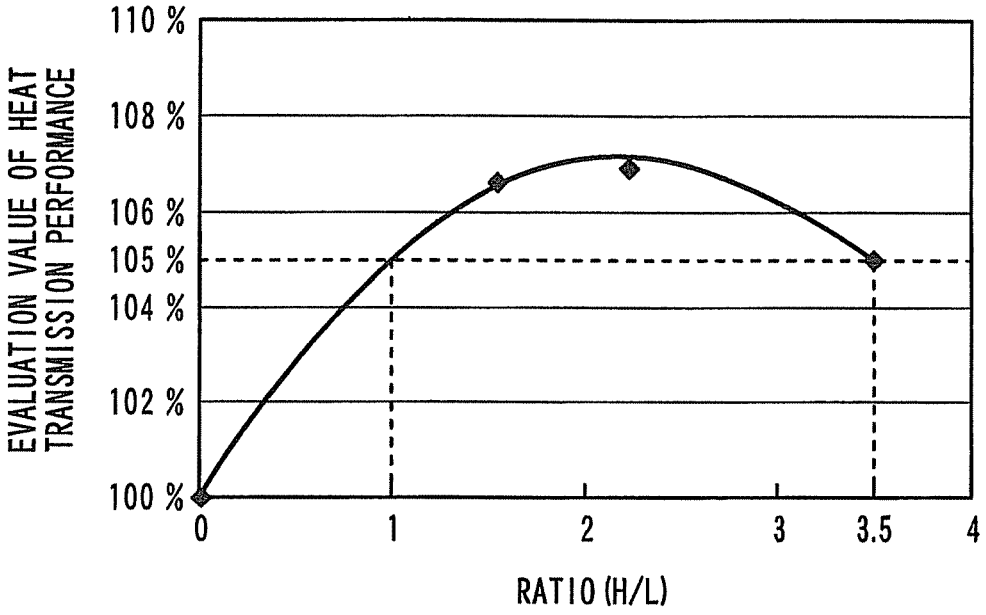
FIG. 6 is a graph for evaluating heat exchanging performance of a heat exchanger when a pump power of a blower fan is set at constant.

The evaluation result of the heat transmission performance will be described based on FIG. 6. FIG. 6 is a diagram for explaining the evaluation result of the heat transmission performance when the pump power of the blower fan is constant. In FIG. 6, the horizontal axis shows the ratio H/L of the projection height H of the protrusion portion 11*a* to the length L of the non-cut portion 2*e*, and the vertical axis shows an evaluation value E of the heat transmission performance defined by the following formula F1.

$$E=(\alpha/\alpha s)/(dPa/dPas)^{1/3} \quad \text{(F1)}$$

Here, α indicates the heat transmission efficiency and dPa indicates a friction resistance force in the heat exchanger provided with the protrusion portions 11*a*, and αs indicates the heat transmission efficiency and dPas indicates a friction resistance force in the heat exchanger without the protrusion portions 11*a*. The expression F1 is a general expression showing the evaluation value E of heat transmission performance of such as a heat exchanger with a constant pump power, as in described in "Principles of Enhanced Heat Transfer, Second Edition (author Ralph L. Webb, Nae-Hyun Kim), publishing company Taylor & Francis p. 58 and 59".

As shown in FIG. 6, the evaluation value E of the heat transmission performance becomes maximum (e.g., 107%), when the ratio (H/L) of the protrusion height H of the protrusion portion 11*a* to the length L of the non-cut portion 2*e* is set about at 2.2 in a case where the pump power of the blower fan is constant. In a range where the evaluation value E of the heat transmission performance is equal or larger than 105%, the heat transmission performance can be effectively improved even when the products of the heat exchanger have variations therebetween. Thus, when the ratio (H/L) of the protrusion height H of the protrusion portion 11*a* to the length L of the non-cut portion 2*e* is set in a range of 1.0 to 3.5 (i.e., $1.0 \leq H/L \leq 3.5$), the heat transmission performance of the heat exchanger can be surely improved.

As described above, when the protrusion height H of the protrusion portions 11*a*, provided on the flat surface 10 of the tube 1 as the flow resistance portion 11, is made larger than the length L of the non-cut portion 2*e*, the flow resistance of air flowing in the non-cut portion 2*e* without the louvers 2*c* can be increased.

Thus, the flow speed and the flow amount of air passing through the non-cut portion 2*e* without the louver 2*c* on the fin plate surface can be reduced, as well as, the flow speed and the flow amount of air passing through the louver forming portion 2*d* provided with the louvers 2*c* can be effectively increased. Therefore, heat transmission performance of the heat exchanger can be sufficiently improved.

Accordingly, when the protrusion height H of the protrusion portion 11*a* is set in a range of 1.0 to 3.5, the heat transmission performance can be effectively, improved.

The protrusion portions 11*a* are formed integrally with the tube 1, by protruding a part of the flat surface 10 from the inside of the tube 1 where the engine coolant flows, to the outside of the tube 1 where air flows. Thus, the recess portions 12 are formed inside the tube 1, at positions where the protrusion portions 11*a* are formed.

Thus, the fluid such as the engine coolant flowing inside the tubes 1 are disturbed, thereby also improving the heat transmission performance on the fluid side (engine coolant side).

Furthermore, in the heat exchanger according to the present embodiment, the protrusion portions 11*a* are arranged in the coolant flow direction (tube longitudinal direction) to be spaced by the pitch dimension FP of the fin 2, as shown in FIG. 3A. Therefore, when the fin 2 is bonded to the tubes 1, the position of the fin 2 can be easily set. Therefore, product performance of the heat exchanger can be improved.

Other Embodiment

Although the present invention has been fully described in connection with the preferred embodiments thereof with reference to the accompanying drawings, it is to be noted that various changes and modifications will become apparent to those skilled in the art.

Figure 7A:
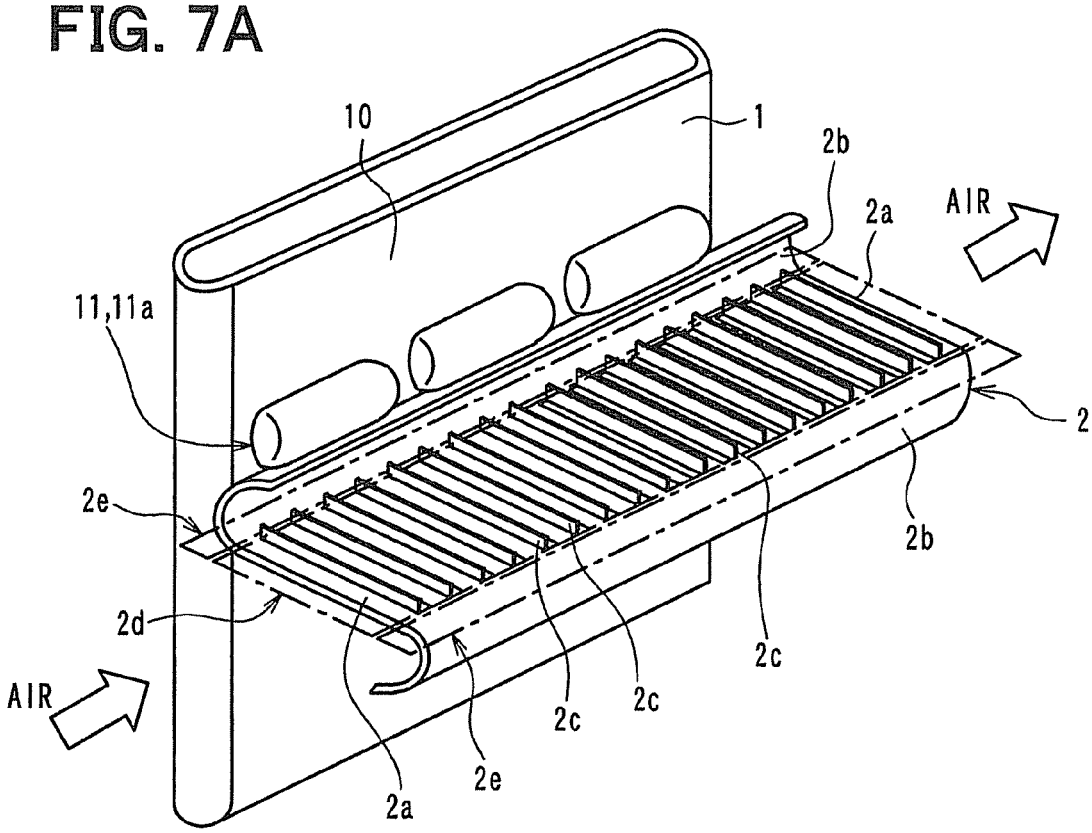
FIGS. 7A and 7B are schematic perspective views each showing a flow resistance portion provided on a flat surface of a tube, according to modification examples of the embodiment of the invention.
Figure 7B:
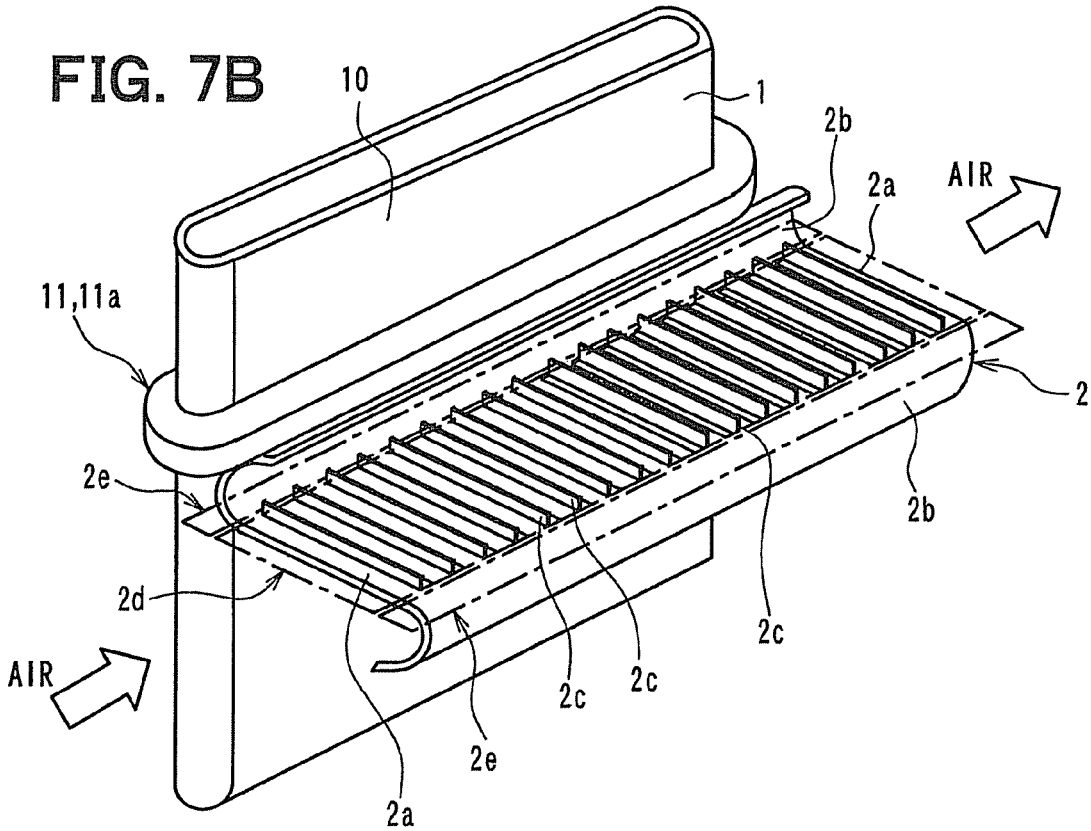

(1) In the above described embodiment, each protrusion portion 11*a* is formed into a semisphere shape to protrude from the flat surface 10 to outside of the tube 1. However, the protrusion shape of the protrusion portion 11*a* is not limited to the semisphric shape. For example, as shown in FIG. 7A, the flow resistance portion 11 may be configured by a plurality of half-ellipsoid protrusion portions 11*a* arranged in a line in the air flow direction. Alternatively, as shown in FIG. 7B, the flow resistance portion 11 may configured by a single columnar protrusion portions 11*a* continuously extending on the tube 1 in the air flow direction. FIGS. 7A and 7B shows only examples of modified shapes of flow resistance portion 11 of the above described embodiment. The flow resistance portion 11 may be changed to other shapes.

(2) In the above-described embodiment and modification examples thereof, the protrusion portions 11*a* as the flow resistance portion 11 are formed integrally with the tube 1, by protruding a part of the flat surface 10 from the inside of the tube 1 where the engine coolant flows, to the outside of the tube 1 where air flows. However, the protrusion portions 11*a* as the flow resistance portion 11 may be formed separately from the tube 1 and may be bonded to the tube 1. In this case, the protrusion portions 11*a* can be bonded to the outer flat surface of an existing tube 1, and thereby it is unnecessary to change the shape of the general tube. Thus, the product performance of the heat exchanger can be improved.

(3) In the above-described embodiment, the protrusion portions 11*a* are provided on both the opposite flat surfaces 10 of each tube 1, and are arranged to be spaced from each other in the direction perpendicular to the air flow direction by the pitch dimension of the fin 2. However, the arrangement of the protrusion portions 11*a* is not limited to it.

Figure 8A:
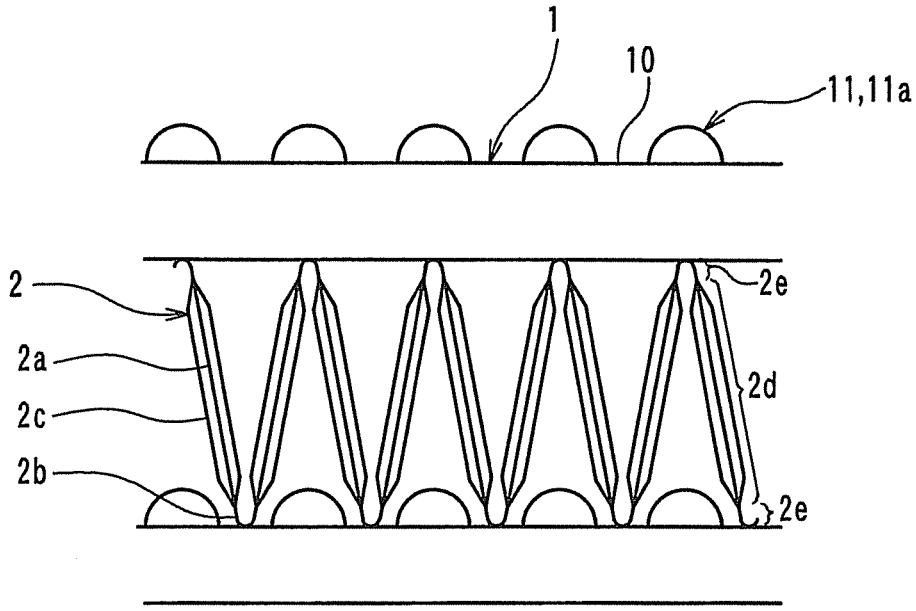
FIGS. 8A and 8B are schematic diagrams each showing a flow resistance portion provided on a flat surface of a tube, according to another modification examples of the embodiment of the invention.

For example, as shown in FIG. 8A, the protrusion portions 11*a* as the flow resistance portion 11 may be provided on one flat surface 10 of the tube 1, while the protrusion portions 11*a* are not formed on the other flat surface of the tube 1 opposite to the one flat surface 10. When the protrusion portions 11*a* are provided on one flat surface 10 of the tube 1, the heat transmission performance on the air side can be increased as compared with the tube without any the protrusion portion 11*a*. Furthermore, in this case, the fin 2 can be easily arranged at a suitable position.

Figure 8B:
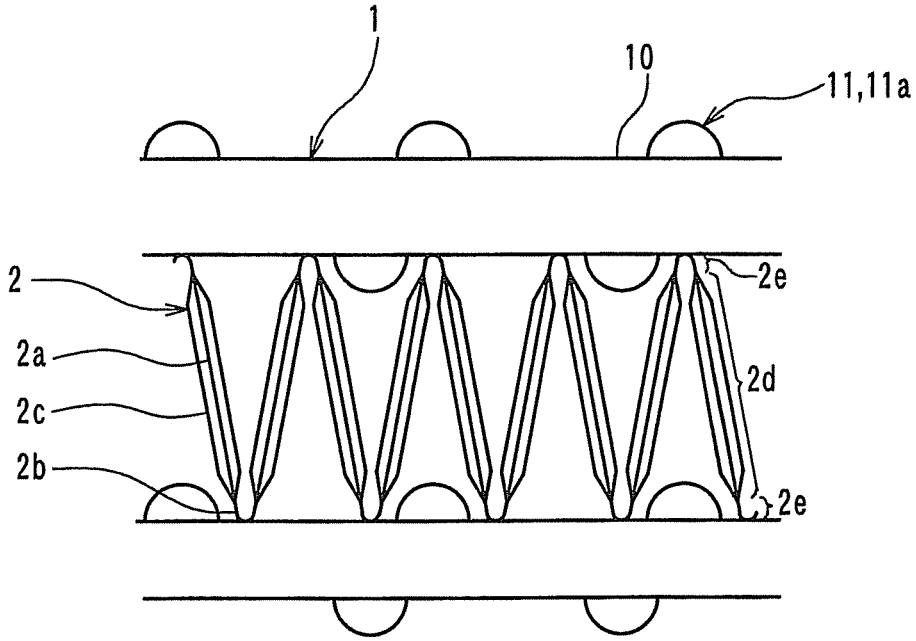

Furthermore, the protrusion portions 11*a* as the flow resistance portion 11 may be arranged to be spaced by a distance corresponding to several-times (e.g., twice) of the pitch of the fin 2, as shown in FIG. 8B. FIGS. 8A and 8B are modified examples in the arrangement of the protrusion portions 11*a*. The other parts may be similar to those of the above described first embodiment.

(4) In the above-described embodiment, the protrusion portions 11*a* are provided on the flat surface 10 of the tube 1, and are arranged in the air flow direction to be spaced from each other at the same interval in the air flow direction. However, the arrangement of the protrusion portions 11*a* is not limited in line along the air flow direction. For example, the protrusion portions 11*a* may be provided on the flat surface 10 of the tube 1 only on the upstream air side, while the protrusion portions 11*a* are not formed on the downstream air side of the flat surface 10 of the tube 1. Alternatively, the number of the protrusion portions 11*a* provided on the flat surface 10 of the tube 1 may be set larger on the upstream air side in the air flow direction, than the number of the protrusion portions 11*a* on the downstream air side in the air flow direction.

Figure 9:
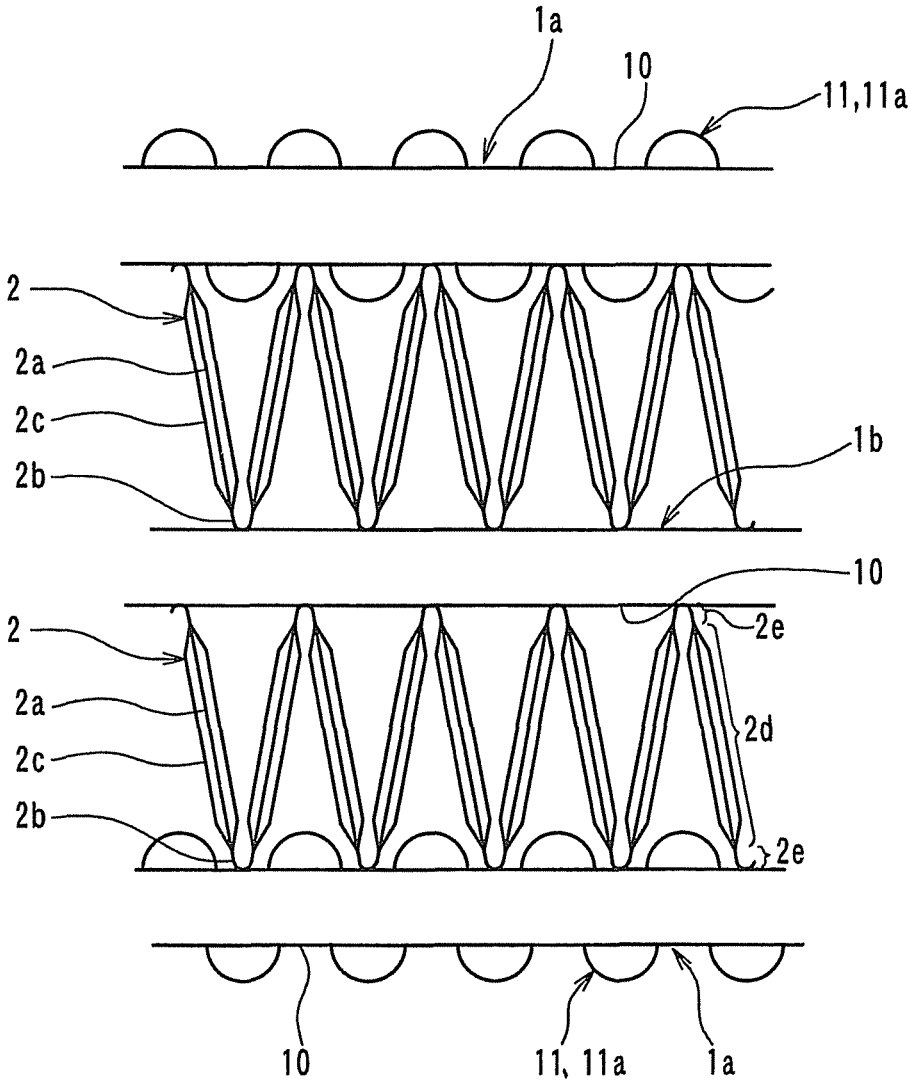
FIG. 9 is a schematic diagram each showing a flow resistance portion provided on flat surfaces of tubes according to another modification example of the embodiment of the invention.

(5) Moreover, in the above-described embodiment, the protrusion portions 11*a* as the flow resistance portion 11 are provided on each flat surface 10 of the plural tubes 1. However, the protrusion portions 11*a* as the flow resistance portion 11 may be provided on a part tube among the plural tubes 1. For example, as shown in FIG. 9, a first tube 1*a* is provided with the flow resistance portion 11, and a second tube 1*b* is not provided with the flow resistance portion 11. The first tube 1*a* provided with the flow resistance portion 11 and the second tube 11*b* without the flow resistance portion 11 may be alternatively arranged in the tube stacking direction. In this case, it is possible to use the existing tubes as the second tubes 11*b*, among a part of the plural tubes 1. Thus, product performance of the heat exchanger can be improved.

Figure 10:
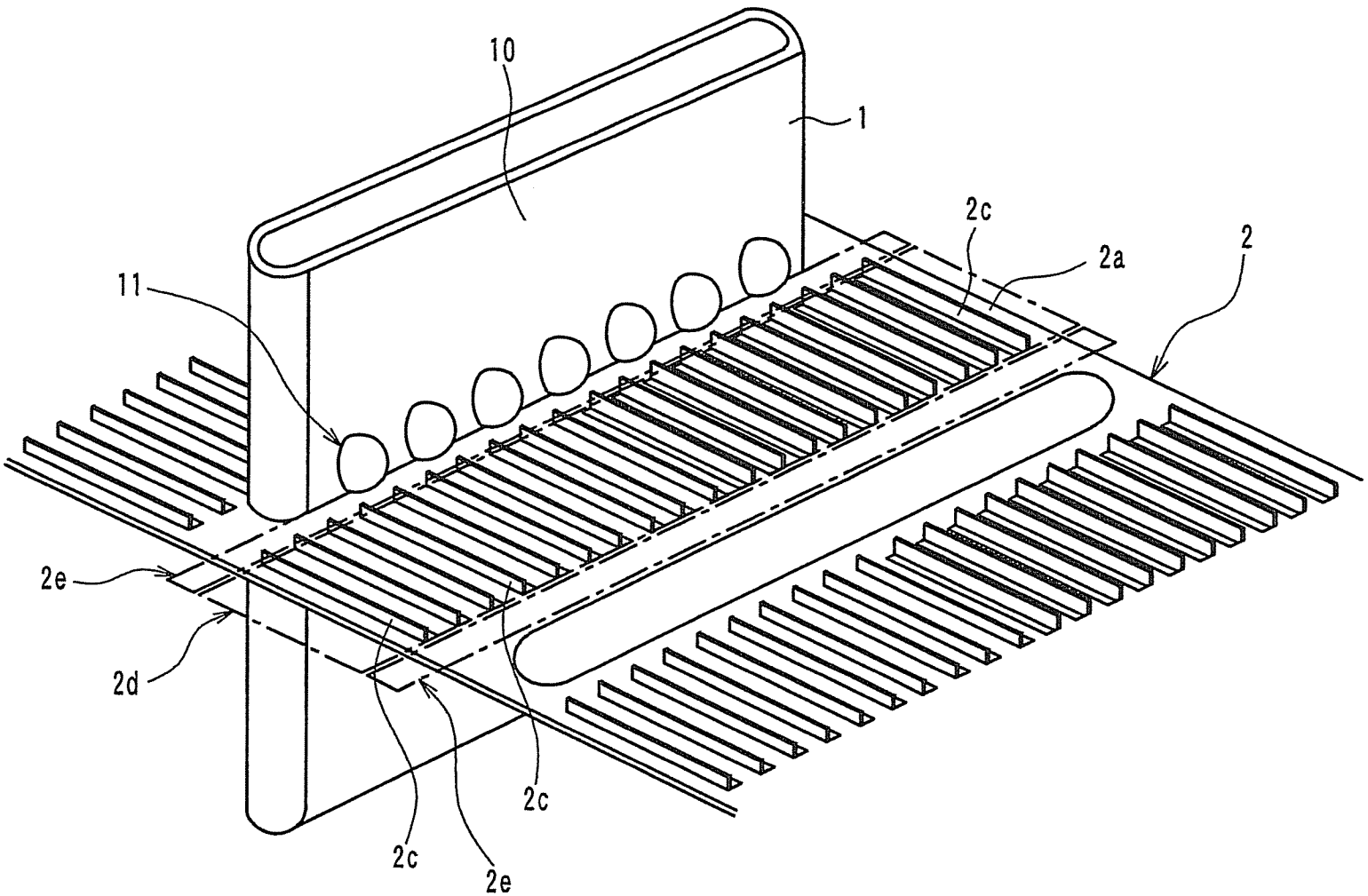
FIG. 10 is a perspective view showing a part of a heat exchanger according to the other embodiment of the invention.

(6) Moreover, in the above-described embodiment, the fin 2 is a corrugated fin. However, as shown in FIG. 10, a plate fin may be used as the fin 2. In this case, the fin pitch FP is a distance between adjacent fins 2 in the direction (tube longitudinal direction) perpendicular to the air flow direction.

(7) Further, in the above-described embodiment, the protrusion portions 11*a* (outer protrusion portions) used as the flow resistance portion 11 are provided on the outer face of the flat surface 10 of the tube 1, to protrude from the outer face of the flat surface 10 of the tube 1 to an outside (i.e., air side). However, in addition to the outer protrusion portions 11*a*, inner protrusion portions may be provided on an inner face of the flat surface 10 of the tube 1, to protrude from the inner face of the flat surface 10 of the tube 1 to an inside of the tube 1 (i.e., coolant flow side).

Figure 11A:
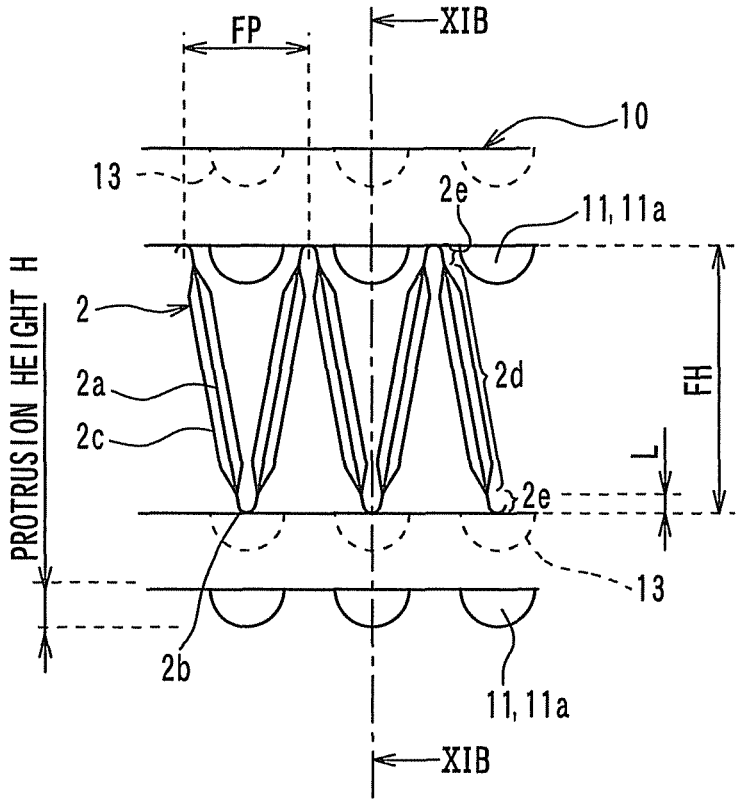
FIG. 11A is a schematic diagram showing a flow resistance portion and inner protrusion portions provided on a flat surface of a tube according to another modification example of the embodiment of the invention.
Figure 11B:
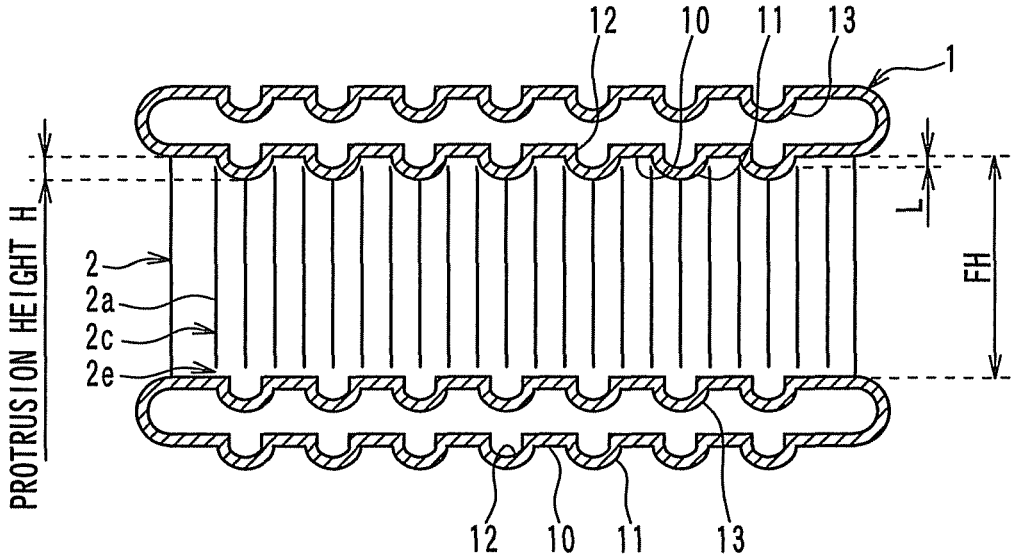
FIG. 11B is a cross-sectional view taken along the line XIB-XIB in FIG. 11A.

FIGS. 11A and 11B shows a modification example of the invention, in which a pair of the flat surfaces 10 of the tube 1 is provided with the outer protrusion portions and the inner protrusion portions. FIG. 11A is a diagram corresponding to FIG. 3A of the above embodiment, and FIG. 11B is a diagram corresponding to FIG. 3B of the above embodiment.

In the example of FIGS. 11A and 11B, a plurality of outer protrusion portions 11*a* are provided as the flow resistance portion 11 on one flat surface 10 of the tube 1 to protrude from the outer face of the flat surface 10 of the tube 1 to an outside, and a plurality of inner protrusion portions 13 are provided on the other flat surface 10 of the tube 1 opposite to the one flat surface 10, to protrude inside of the tube 1. That is, the inner protrusion portions 13 protrude from the other flat surface 10 of the tube 1 to the coolant flow side, similarly to the arrangement of the outer protrusion portions 11*a* of the one flat surface 10 of the tube 1.

In the example of FIGS. 11A and 11B, the number of the inner protrusion portions 13 is set equal to that of the outer protrusion portions 11*a*. Furthermore, the shape of the inner protrusion portion 13 is formed into a semi-spherical shape similar to that of the outer protrusion portion 11*a* such that the protrusion height of the semi-spherical shaped inner protrusion portion 13 is substantially equal to the protrusion height of the semi-spherical shaped outer protrusion portion 11*a*. However, the shape of the inner protrusion portion 13 may be made to be different from the shape of the outer protrusion portion 11*a* as the flow resistance portion 11, or the protrusion height of the inner protrusion portion 13 may be made to be different from the protrusion height of the outer protrusion portion 11*a* while having a similar shape.

In the modification example shown in FIGS. 11A, 11B, the tube 1 includes a pair of different flat surfaces 10 opposite to each other. That is, one of the two opposite flat surfaces 10 of the tube 1 has the outer protrusion portions 11*a*, and the other one of the two opposite flat surfaces 10 of the tube 1 has the inner protrusion portions 11*a*, so that each tube 1 is formed. In the flat surface 10 provided with the outer protrusion portions 11*a* of the tube 1, the flow speed, the flow amount and the like of air flowing through the non-cut portion 2*e* without having the louvers 2*c* can be reduced, and the flow speed, the flow amount and the like of air flowing through the louver forming portion 2*d* provided with the louvers 2*c* can be increased, thereby improving heat transmission performance on the air side in the heat exchanger.

A heat quantity Q passing the flat surface 10 provided with the outer protrusion portion 11*a* can be calculated based on the following formulas F2 and F3.

$$Q=K\cdot Fa\cdot \Delta Tm \quad \text{(F2)}$$

$$1/K=(1/\alpha a)+[Fa/(\alpha w\cdot Fw)]+t/\lambda \quad \text{(F3)}$$

Here, K is a heat transfer coefficient, ΔTm is a logarithmic mean temperature, αa is a heat transmission ratio on air side, αw is a heat transmission ratio on engine-coolant side, Fa is a heat transmission area on air side, Fw is a heat transmission area on engine-coolant side, t is a plate thickness of the tube 1, and λ is a heat conductive coefficient.

In the heat exchanger having the tubes 1 shown in FIGS. 11A and 11B, the heat transmission ratio αa on air side can be increased, as well as the heat transmission ratio αw on engine-coolant side and the heat transmission area Fw on engine-coolant side can be increased. Therefore, the heat transfer coefficient K is increased, and the heat quantity Q passing through the flat surface 10 provided with, the outer protrusion portions 11*a* can be increased. As a result, the heat transmission performance of the heat exchanger can be improved.

Furthermore, because the other flat surface 10 of the tube 1, among the pair of the opposite flat surfaces 10, is provided with the inner protrusion portions 13, the heat transmission area of the engine coolant in the tube 1 can be increased, and the passage of the engine coolant in the tube 1 can be made in a meandering passage shape. Therefore, the engine coolant flowing in the tube 1 can be sufficiently disturbed to be mixed. Thus, the heat transmission performance on the side of the engine coolant flowing in the tube 1 can be effectively improved.

Figure 12:
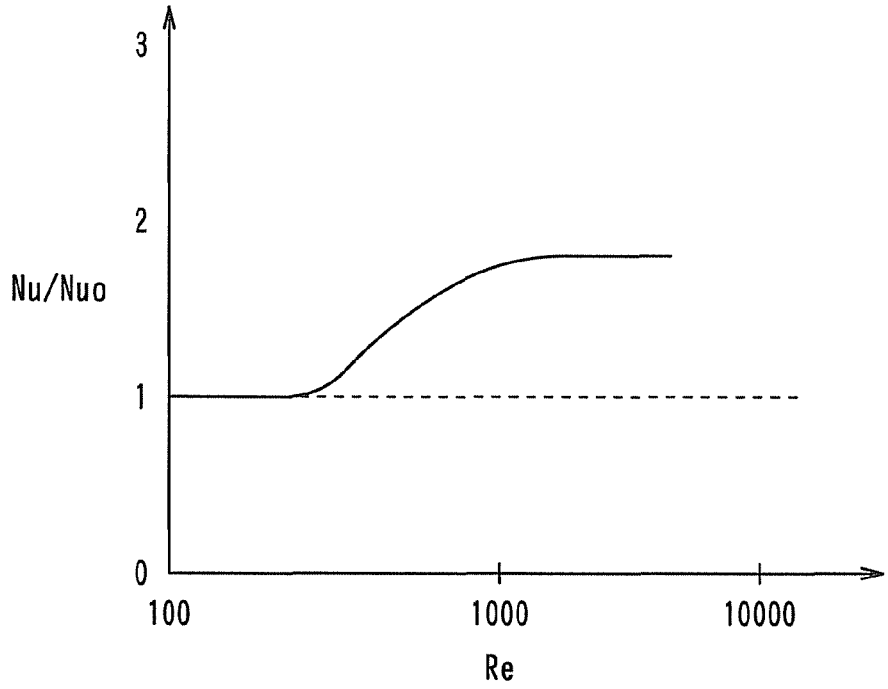
FIG. 12 is a graph showing the relationship between Reynolds number (Re) and a heat transmission performance ratio (Nu/Nuo) on an engine coolant side.

FIG. 12 shows the relationship between Reynolds number Re of the flow of the engine coolant flowing in the tube 1 shown in FIGS. 11A and 11B, and a heat transmission performance ratio (Nu/Nuo) of the engine-coolant side. In FIG. 12, the chain line indicates the heat transmission performance ratio (Nu/Nuo) in a comparison example in which the tube is a flat tube without the outer protrusion portions 11*a* and the inner protrusion portions 13. As compared with the comparison example, the heat transmission performance can be improved in the tube 11 of the example of FIGS. 11A and 11B, as in the solid line graph of FIG. 12. In FIG. 12, the horizontal axis indicates the Reynolds number (Re), and the vertical axis indicates a heat transmission performance ratio (Nu/Nuo). The heat transmission performance ratio (Nu/Nuo) is a ratio of Nusselt number Nu of a flow of the engine coolant in the tube 1 having the flow resistance portion 11 and the inner protrusion portions 13 of FIGS. 11A and 11B, to Nusselt number Nuo of a flow of the engine coolant in the tube without the flow resistance portion 11 and the inner protrusion portions 13.

As shown in FIG. 12, when the Reynolds number Re is larger than a predetermined value, the heat transmission performance ratio (Nu/Nuo) becomes larger than 1. Thus, the heat transmission performance of the heat exchanger having the tube 1 shown in FIGS. 11A and 11B can be effectively improved as compared with the comparison example.

Figure 13:
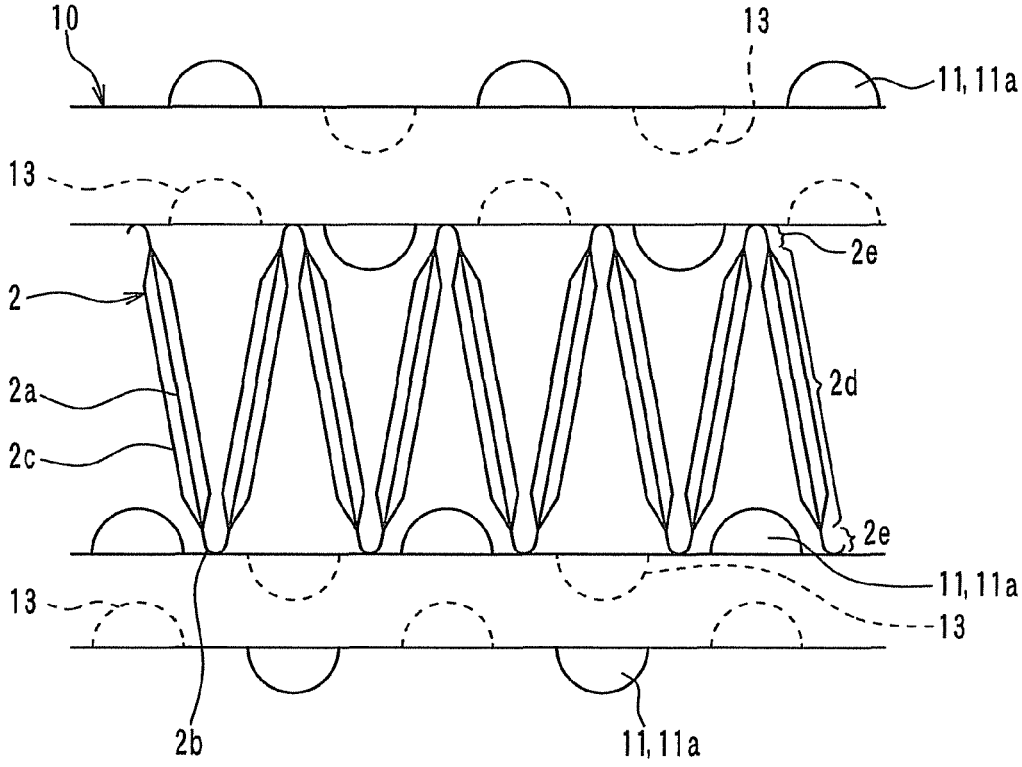
FIG. 13 is a schematic diagram showing a flow resistance portion and inner protrusion portions provided on a flat surface of a tube according to another modification example of the embodiment of the invention.

In the example of FIGS. 11A and 11B of the invention, the tube 1 is configured such that one of the two flat surfaces 10 of the tube 1 has the outer protrusion portions 11*a* as the flow resistance portion 11, and the other one of the two flat surfaces 10 of the tube 1 has the inner protrusion portions 13. However, the arrangement of the protrusion portions 11*a*, 13 is not limited to that of FIGS. 11A and 11B. For example, each flat surface 10 of the tube 1 may be provided with the outer protrusion portions 11*a* as the flow resistance portion 11 and the inner protrusion portions 13, as shown in FIG. 13. In the example of FIG. 13 of the invention, the outer protrusion portions 11*a* and the inner protrusion portions 13 are alternatively arranged on each flat surface 10. Even in the example of FIG. 13, the effects of the tube 11 shown in FIGS. 11A, 11B can be obtained.

The arrangement of the outer protrusion portions 11*a* and the inner protrusion portions 13 may be suitably changed without being limited to the examples shown in FIGS. 11A, 11B, 13.

(8) Furthermore, in the above-described embodiment, a part of the plate portion 2*a* of the fin 2 is cut to be protruded thereby forming the slit-window shaped louvers 2*c* as the fin protrusions. However, the fin 2 with the louvers 2*c* is not limited to it. For example, the plate portion 2*a* of the fin 2 may be bent to have band-shaped protrusion portions of the fin 2, such that the protrusion portions of the fin 2 are offset from each other or zigzag in the air flow direction.

(9) In the above-described embodiment, the heat exchanger of the present invention is typically used as the heater core for a vehicle air conditioner. However, the heat exchanger of the present invention may be used for the other use. For example, the heat exchanger of the present invention may be used as a radiator, an evaporator, a condenser, etc., without being limited to the heater core of the vehicle air conditioner.

(10) Furthermore, in the above-described embodiment and modified examples thereof, the tube 1 and the fin 2 are bonded by brazing. However, the tube 1 can be mechanically connected to the fin 2 by expanding outwardly the inner dimension of the tube 1.

(11) In addition, in the above-described embodiment, the louver forming portions 2*d* include the area of the completely cut portions, as well as, the area connecting the plate portion 2*a* of the fin 2 in the cut portions.

Such changes and modifications are to be understood as being within the scope of the present invention as defined by the appended claims.

What is claimed is:

1. A heat exchanger comprising:

a plurality of flat tubes in which a fluid flows, each tube including a first flat surface and a second flat surface opposite to the first flat surface;

a plurality of fins each of which is connected to adjacent flat surfaces of adjacent tubes to increase a heat exchange area on a side of air flowing outside of the tubes;

a flow resistance portion comprising a plurality of outer protrusion portions protruding from only the first flat surface of each of the tubes to an outside of each of the tubes by a protrusion dimension; and, a plurality of inner protrusion portions protruding from only the second flat surface of each of the tubes to an inside of each of the tubes, the outer protrusion portions and the inner protrusion portions being aligned with one another in a tube stacking direction, the plurality of outer protrusion portions being aligned with one another along a direction perpendicular to a coolant flow direction in the flat tubes, and the plurality of inner protrusion portions being aligned with one another along a direction perpendicular to the coolant flow direction in the flat tubes; wherein the fin includes a plate portion having a plate surface, and fin protrusions protruding from the plate surface of the plate portion, the fin protrusions are provided to be spaced from the flat surface of the tube by a distance, the protrusion dimension of the flow resistance portion protruding from the flat surface of the tube is equal to or larger than the distance, the surface of the fin is attached to each of the tubes at positions overlapping each of the plurality of inner protrusion portions; and the first flat surface having the outer protrusion portions and the second flat surface having the inner protrusion portions directly define a single fluid passage in which the fluid flows.

2. The heat exchanger according to claim 1, wherein a ratio of the protrusion dimension of the flow resistance portion to the distance is in a range of from 1 to 3.5.

3. The heat exchanger according to claim 1, wherein a part of the first flat surface of the tube protrudes from an inside of each of the tubes to the outside of each of the tubes, to form the flow resistance portion and a recess portion that is provided on an inner wall surface of the tube at a position where the flow resistance portion is provided.

4. The heat exchanger according to claim 1, wherein the flow resistance portion is a member different from the tube, and is bonded to the flat surface of the tube.

5. The heat exchanger according to claim 1, wherein the flow resistance portion is provided on the first flat surface of the tube at least at an upstream portion in an air flow direction.

6. The heat exchanger according to claim 1, wherein the plurality of outer protrusion portions are arranged at an interval of a pitch dimension of the fin in a flow direction of the fluid flowing in the tube.

7. The heat exchanger according to claim 1, wherein the plurality of tubes include a first plurality of tubes each of which is provided with the flow resistance portion, and a second plurality of tubes without the flow resistance portion, and the first plurality of tubes and the second plurality of tubes are alternately arranged in a tube stacking direction.

8. The heat exchanger according to claim 1, wherein each of the plurality of outer protrusion portions protrude from the first flat surface of the tube to the outside of each of the tubes, and has approximately a semispheric shape.

9. The heat exchanger according to claim 1, wherein the fin is a corrugated fin bent in a wave shape.

10. The heat exchanger according to claim 1, wherein the fin protrusions are slit-window shaped louvers that are provided by cutting and standing a part of the plate portion of the fin.

11. The heat exchanger according to claim 10, wherein the fin has a louver forming portion in which the louvers are provided, and a non-cut portion at two sides of the louver forming portion in the tube stacking direction, the non-cut portion of the fin is connected to the flat surface of the tube, and the protrusion dimension of the flow resistance portion is equal to larger than a dimension of the non-cut portion in the tube stacking direction.

12. The heat exchanger according to claim 1, wherein the plurality of outer protrusion portions, are arranged in line at an interval in an air flow direction.

13. A heat exchanger comprising:

a plurality of flat tubes in which a fluid flows, each tube including a first flat surface and a second flat surface opposite to the first flat surface;

a plurality of fins each of which is connected to adjacent flat surfaces of adjacent tubes to increase a heat exchange area on a side of air flowing outside of the tubes;

a flow resistance portion comprising a plurality of outer protrusion portions protruding from only the first flat surface of each of the tubes to an outside of each of the tubes by a protrusion dimension; and a plurality of inner protrusion portions protruding from only the second flat surface of each of the tubes to an inside of each of the tubes, the outer protrusion portions and the inner protrusion portions being aligned with one another in a tube stacking direction, the plurality of outer protrusion portions being aligned with one another along a direction perpendicular to a coolant flow direction in the flat tubes, and the plurality of inner protrusion portions being aligned with one another along a direction perpendicular to the coolant flow direction in the flat tubes; wherein the fin includes a plate portion having a plate surface, and fin protrusions protruding from the plate surface of the plate portion, the fin protrusions are provided to be spaced from the flat surface of the tube by a distance, the protrusion dimension of the flow resistance portion protruding from the flat surface of the tube is equal to or larger than the distance, the surface of the fin is attached to each of the tubes at positions between adjacent outer protrusion portions; and the first flat surface having the outer protrusion portions and the second flat surface having the inner protrusion portions directly define a single fluid passage in which the fluid flows.

14. A heat exchanger comprising:

a plurality of flat tubes in which a fluid flows, each tube including a first flat surface and a second flat surface opposite to the first flat surface;

a plurality of fins each of which is connected to adjacent flat surfaces of adjacent tubes to increase a heat exchange area on a side of air flowing outside of the tubes;

a flow resistance portion comprising a plurality of outer protrusion portions protruding from only the first flat surface of each of the tubes to an outside of each of the tubes by a protrusion dimension; and a plurality of inner protrusion portions protruding from only the second flat surface of each of the tubes to an inside of each of the tubes, the outer protrusion portions and the inner protrusion portions being aligned with one another in a tube stacking direction, the plurality of outer protrusion portions being aligned with one another along a direction perpendicular to a coolant flow direction in the flat tubes, and the plurality of inner protrusion portions being aligned with one another along a direction perpendicular to the coolant flow direction in the flat tubes; wherein the fin includes a plate portion having a plate surface, and fin protrusions protruding from the plate surface of the plate portion, the fin protrusions are provided to be spaced from the flat surface of the tube by a distance, the protrusion dimension of the flow resistance portion protruding from the flat surface of the tube is equal to or larger than the distance, the inner protrusion portions are positioned directly opposite to the outer protrusion portions; and the first flat surface having the outer protrusion portions and the second flat surface having the inner protrusion portions directly define a single fluid passage in which the fluid flows.

15. The heat exchanger according to claim 1, wherein a thickness of the tube is uniform.

16. The heat exchanger according to claim 1, wherein both the outer protrusion portions and the inner protrusion portions have a semi-spherical shape, and a protrusion height of the outer protrusion portion is equal to a protrusion height of the inner protrusion portion.

17. The heat exchanger according to claim 1, wherein a number of inner protrusion portions is equal to a number of outer protrusion portions.

18. The heat exchanger according to claim 1, wherein the outer protrusion portions and the inner protrusion portions are not staggered across an axis of the tube.

19. The heat exchanger according to claim 1, wherein both the outer protrusion portions and the inner protrusion portions are circular cross-section dimples aligned in rows.

* * * * *